United States Patent [19]

Heaton

[11] 4,452,663

[45] Jun. 5, 1984

[54] WALL BOARD TAPING APPARATUS

[76] Inventor: Wilbur L. Heaton, 8215 Vernier Dr., Lemon Grove, Calif. 92045

[21] Appl. No.: 369,179

[22] Filed: Apr. 16, 1982

[51] Int. Cl.[3] ..... B44C 7/02

[52] U.S. Cl. ..... 156/575; 156/577; 156/579

[58] Field of Search ..... 156/523, 524, 526, 527, 156/574, 575, 577, 579

[56] References Cited

U.S. PATENT DOCUMENTS

| | | | |
|---|---|---|---|
| 1,084,964 | 1/1914 | Richardson | 156/575 |
| 2,502,499 | 4/1950 | Ames | 216/22 |
| 3,138,512 | 6/1964 | Partin | 156/461 |
| 3,598,683 | 8/1971 | Butler et al. | 156/527 |
| 3,753,839 | 8/1973 | Funke et al. | 156/577 |
| 3,880,701 | 4/1975 | Moree | 156/575 |
| 4,086,121 | 4/1970 | Ames | 156/526 |
| 4,196,028 | 4/1980 | Mills et al. | 156/71 |

*Primary Examiner*—Michael G. Wityshyn
*Attorney, Agent, or Firm*—Brown & Martin

[57] ABSTRACT

A wall board joint taping apparatus includes an elongated frame having a tape press wheel mounted on the forward end with a compound reservoir mounted on the frame intermediate the ends with aligned slots through the lower edge of the walls with a source of tape mounted on the other end of the frame with the tape passing through the slots in the compound container for picking up taping compound on the surface thereof and passing over the roller for application and pressing by the press wheel into a joint between adjacent wall board panels.

9 Claims, 3 Drawing Figures

WALL BOARD TAPING APPARATUS

BACKGROUND OF THE INVENTION

Drywall in the form of gypsum wall board is used extensively throughout the building industry today. Such wall board normally is manufactured in 4×8 foot panels and are easily applied to interior surfaces of the studs of building frames for forming interior walls of homes and other buildings. Such wall board eliminates the need for expensive and time consuming plaster as in the past.

The joint between panels of wall board are typically sealed and covered by a tape and a taping conpound sometimes referred to as spackling compound or mud. Machines have been developed for the simultaneous application of a tape and a taping compound to such joints. The most effective of such machines, however, are highly complicated and expensive and therefore not practical for the small contractor, hobbyist, or home owner.

Many attempts have been made in the past to provide an effective, simple and inexpensive taping apparatus for wall board. These apparatus' however have certain drawbacks including complexity and expense to manufacture.

It is desirable that a simple and effective wall board taping apparatus be available that is effective and inexpensive.

SUMMARY AND OBJECTS OF THE PRESENT INVENTION

It is the primary object of the present invention to provide an improved wall board joint taping apparatus.

In accordance with the primary aspect of the present invention, a wall board joint taping apparatus comprises a frame having a tape application roller on one end thereof with a tape compound container intermediate the ends with openings for passing a tape therethrough and a tape rolled mounting means on the opposite end for mounting a tape to be passed through the compound container for picking up a quantity of compound on the surface thereof and trailing over the roller to be applied to a wall board joint. Means are provided for adjusting the quantity of compound carried on the tape from the container.

BRIEF DESCRIPTION OF THE DRAWINGS

The above and other objects and advantages of the present invention will become apparent from the following description when read in conjunction with the accompanying drawings wherein.

DETAILED DESCRIPTION OF A PREFERRED EMBODIMENT

Figure 1:
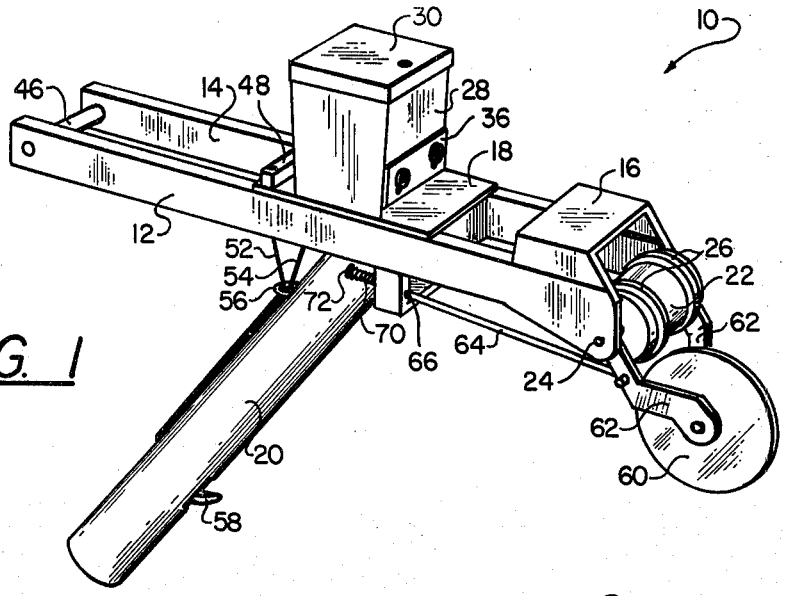
FIG. 1 is a perspective view of a taping apparatus in accordance with the invention.
Figure 2:
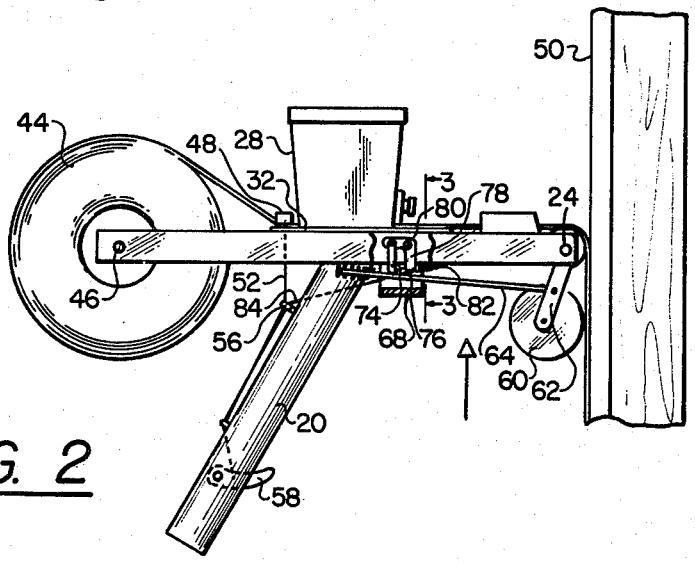
FIG. 2 is a side elevation view of the apparatus of FIG. 1.
Figure 3:
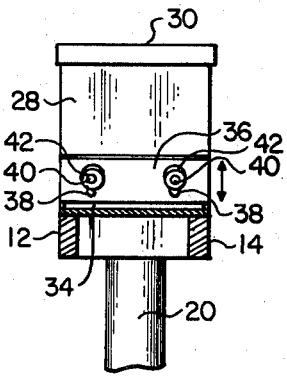
FIG. 3 is a section view generally on line 3—3 of FIG. 2.

Turning to the drawings, a wall board taping apparatus in accordance with the invention is disclosed designated generally by the numeral 10 and comprising an elongated frame comprising a pair of elongated generally rectangular bar members 12 and 14 secured together in parallel relationship by a bracket member 16 and a plate 18. A handle 20 having a generally cylindrical configuration is secured such as to the cross plate 18 and extends downward at an angle on the order of approximately 45° from the angle of the frame members 14 and 16. The handle is preferably of such length to enable grasping and manipulating by both hands when necessary.

A tape press wheel or roller 22 is rotatably mounted on a shaft or spindle 24 secured between the frame members 12 and 14 at the forward end thereof. A pair of spaced apart rings 26 are mounted on the roller 22 for engaging and pressing a tape into a wall board joint channel between a pair of adjacent wall board panels.

A reservoir or container 28 for holding a quantity of taping compound is mounted on the frame such as to the plate 18. The container includes a suitable sealable cover or closure 30 to provide access to the interior thereof for filling or the like. The preferred form of the container is substantially box-type with rectangular sides as illustrated such that tape passage or slots 32 and 34 can be formed along the lower edge thereof adjacent the bottom for passage of a tape through the container for picking up the taping compound. The tape passage or slot 34 which may be termed an outlet or exit slot is variable in heighth by means of a movable plate or cover 36 having a pair of vertically elongated slots 38 formed therein for fitting over a pair of studs 40 on which are mounted thumb screws 42. This permits the operator to loosen the thumb screws 42 and slide the plate upward or downward to vary the thickness of the compound on the upper surface of the tape as it flows from the container or moves from the exit of the container.

A source of tape such as a roll 44 is rotatably mounted on a shaft 46 mounted between the bars 12 and 14 of the frame at the back end thereof. The tape is trailed from the roll and passes beneath a brake shoe 48 through the inlet slot 32 into the reservoir 28 passing along the bottom thereof with compound in the container clinging to the tape as it emerges from the exit slot 34 and passes over the tape roller 22 to be applied to the surface of the wall board 50.

The brake member 48 is in the form of a block or the like that is mounted, for example, on a pair of spaced apart vertical pins which, in turn, extend through bores in the plate 18 and to which are connected a pair of cord or cable members 52 and 54 extending through a guide member 56 on handle 20 a trigger 58 for activating the brake. The brake is activated by squeezing the trigger when the end of a run is reached or otherwise is desired to cut the tape. The application of the brake holds the tape so that it may be maintained in tension as a knife is used to cut the tape below the roller 22.

A corner attachment or modification for the apparatus includes a tape engaging disc or suitable narrow edged roller 60 rotatably mounted on arms 62 which are pivotally mounted on the shaft 24. A biasing link 64 is pivotally connected to the arm 62 and extends through a bore 66 in a bracket 68 extending downward from the frame 12, 14. A coil spring 70 biased between the bracket 68 and a radial flange 72 on the end of the biasing link 64. A latching dog 74 engages a latching notch 76 in the biasing link 64 and is pivotally mounted on the outer end of one arm of a bell crank 78 which is pivotally mounted at 80 on the frame member 12. A tension spring 82 biased the latch assembly into the engaged position. A trip cable 84 extends through guide 56 and down the handle to a convenient position and connected to a ring or trigger for the brake trigger 58 so that the disc 60 is automatically retracted when the brake is applied. This permits the holding of the tape as it is being cut to its necessary length or position.

The illustrated arrangement is best suited for vertical joint tape application but requires only minor modification for utilization on horizontal joints. For example, the container of reservoir 28 need only be either, oriented such that it is vertical with slots in the side as the apparatus is oriented horizontally or, in the alternative the reservoir need only be made of a width such that compound within the container is always above and is, under pressure, as applied to the surface of the tape. The container, therefore, may extend to one or both sides of the frame and tape, such that, as the apparatus is tilted to the side the level of compound within the container is still above the upper edge of the tape, such that, the compound is applied by hydrostatic pressure of the flowable compound directly to the surface of the tape.

The present invention provides a simple, effective and inexpensive apparatus for use in taping of drywall joints. While I have illustrated and described my invention by means of specific embodiments, it is to be understood that numerous changes and modifications may be made therein without departing from the spirit and scope of the invention as defined in the appended claims.

I claim:

1. A joint taping tool for taping a joint between adjacent panels of wallboard said tool comprising:

an elongated frame including a pair of spaced apart parallel bars, a first tape press wheel rotatably mounted on a shaft supported between said bars on one end of said frame for pressing a tape into a joint, a reservoir container for containing a joint compound mounted intermediate the ends of said frame and having an inlet slot on one side and a variable height outlet slot on the other side, a source of joint tape including a roll mounted on a shaft supported between said bars on the other end of said frame for passing via said inlet slot and said outlet slot through said housing for picking up joint compound thereon and passing over the press wheel for application to a joint, a handle secured to and extending downward from the frame proximate the center thereof, brake means mounted on said frame for selectively gripping and holding said tape, and a second press wheel movably mounted on said frame beneath said first tape wheel and extendable to a position forward of said first tape wheel for forcing said tape into a corner joint, said second press wheel retractable to a position behind said first press wheel for nonengagement with said tape, and said second press wheel is mounted on linkage means including first latching means for latching said second press wheel in the extended position and including second latching means for latching said second press wheel in the retracted position.

2. The taping tool of claim 1 including a moveable rectangular plate partially covering said outlet slot and selectively moveable for adjusting the height of said slot and thereby adjusting the amount of compound carried on said tape.

3. The taping tool of 1 wherein said second press wheel is a disc for pressing tape into a corner.

4. The taping tool of claim 1 including flexible linkage means connecting said brake means and said latching means to a common actuating trigger for simultaneous actuation.

5. The taping tool of claim 1 wherein said handle extends downward at an angle of about 45° to said frame.

6. The taping tool of claim 1 including trip means on said handle for releasing said first latching means.

7. The taping tool of claim 6 including control means on said handle including linkage means for actuating said brake means.

8. The taping tool of claim 7 wherein said reservoir is of a generally rectangular box-like construction and is mounted substantially at the center of said frame above the point of connection of said handle thereto.

9. The taping tool of claim 8 wherein said first tape press wheel includes spaced apart rings mounted thereon for engagement with and forcing said tape into position.

* * * * *